United States Patent [19]

Pickens et al.

[11] 4,344,115

[45] Aug. 10, 1982

[54] TRANSLUCENT PLASTIC LAMPSHADE

[75] Inventors: Jay W. Pickens, Fort Worth; Linton G. Warren, Crowley, both of Tex.

[73] Assignee: Rangaire Corporation, Cleburne, Tex.

[21] Appl. No.: 177,099

[22] Filed: Aug. 11, 1981

Related U.S. Application Data

[63] Continuation of Ser. No. 5,397, Jan. 22, 1979, abandoned.

[51] Int. Cl.[3] ..... F21S 5/00

[52] U.S. Cl. ..... 362/216; 362/361

[58] Field of Search ..... 362/216, 351, 361, 404, 362/352

[56] References Cited

U.S. PATENT DOCUMENTS

| | | | |
|---|---|---|---|
| 1,537,777 | 5/1925 | Liedtke | 362/351 |
| 1,580,922 | 4/1926 | Scherer | 362/351 |
| 1,901,235 | 3/1933 | Glowacki | 362/404 |
| 2,066,771 | 1/1937 | Doane | 362/11 X |
| 2,819,386 | 1/1958 | Linderoth | 362/352 |
| 3,142,446 | 7/1964 | Okamoto | 362/352 |
| 3,300,885 | 1/1967 | Haire | 362/216 X |
| 3,764,801 | 10/1973 | Mainieks | 362/358 |
| 4,075,684 | 2/1978 | Witz | 362/352 |
| 4,141,061 | 2/1979 | Ford et al. | 362/216 |
| 4,268,896 | 5/1981 | Mann | 362/36 X |

FOREIGN PATENT DOCUMENTS 217449 6/1924 United Kingdom .

*Primary Examiner*—Peter A. Nelson

*Attorney, Agent, or Firm*—Richards, Harris & Medlock

[57] ABSTRACT

A plastic, translucent lampshade comprises a tube with radially inwardly extending flanges at each end. A lens rests upon the lower flange, while a mounting bracket connects to two slots defined in the upper flange to support the lampshade from the ceiling. The surface of the tube is smooth so that decorative self-adhesive paper can be attached.

4 Claims, 7 Drawing Figures

TRANSLUCENT PLASTIC LAMPSHADE

This is a continuation of application Ser. No. 5,397 filed Jan. 22, 1979, and now abandoned.

TECHNICAL FIELD

This invention relates generally to lampshades, and more particularly, to a translucent plastic lampshade which can be inexpensively formed.

BACKGROUND ART

Fluorescent lamps are found in many homes today. Their popularity can be attributed to their low consumption of power, cool temperature in operation, and soft, diffuse light. Round fluorescent lamps in particular are frequently found in kitchens because they do not require a great deal of space and do not generate excessive heat. Round fluorescent lamps, to be esthetically pleasing, are generally provided with a lampshade.

Previous lampshades for round fluorescent lamps have not been completely satisfactory because of their appearance and their cost. One type of prior shade is comprised of a plastic cylinder having a piece of wire taped around its perimeter. Not only has such construction been expensive because of the required hand labor for taping, the shades have not had a long life and have been excessively heavy because of the wires.

In many prior lampshades, the entire lampshade and the lens were supported by the lens. In such a lampshade, a hole is drilled in the lens so that a retaining nut for holding the lampshade in place can be attached to a threaded rod. Such lampshades put an undesirable strain on a lens because the lens supports the shade.

SUMMARY OF THE INVENTION

In accordance with one embodiment of the invention, a lampshade is disclosed comprising a circular translucent shade formed from a flexible tube of plastic. An upper translucent flange is formed from an integral plastic body and is rigidly connected to the upper peripheral edge of the tube. The upper flange extends radially inwardly of the tube and attaches to a bracket. A lower translucent flange is formed from an integral plastic body and is rigidly connected to the upper peripheral edge of the tube. The lower flange extends radially inwardly to form a support surface, and a translucent circular lens having a diameter less than the tube is dimensioned to rest upon the support surface of the lower flange.

In accordance with yet another embodiment of the invention, a lampshade for attachment to a mounting bracket suspended from a ceiling comprises a circular translucent shade formed from a flexible tube of plastic. An upper translucent flange is formed from an integral plastic body with upper and lower surfaces. A lip and a circular groove are formed on the lower surface of the flange, with the lip formed on the peripheral edge of the flange. The tube is rigidly attached to the flange in the groove. A lower translucent flange is formed from an integral plastic body with an upper surface. A lip and a circular groove are formed on the upper surface, with the lip located on the peripheral edge of the flange. The tube is rigidly attached to the lower flange in the groove. A translucent circular lens rests upon the upper surface of the lower flange.

BRIEF DESCRIPTION OF THE DRAWINGS

A more complete understanding of the invention can be had by reference to the following Detailed Description taken in conjunction with the accompanying Drawings wherein.

DETAILED DESCRIPTION

Figure 1:
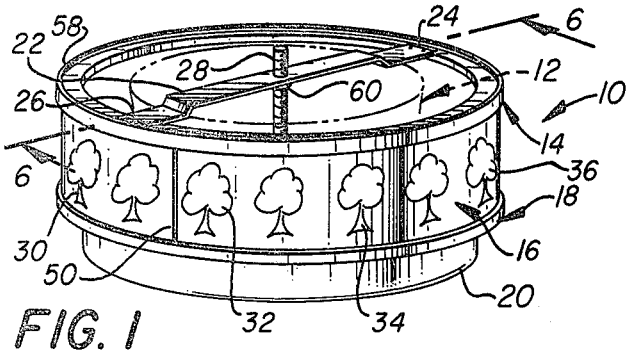
FIG. 1 is a perspective view of a lampshade incorporating the present invention.

Referring now to the Drawings wherein like reference numerals designate like or similar components throughout the several views, there is shown in FIG. 1 an embodiment of the lampshade 10 which is ready for installation in a home. A conventional fluorescent light fixture 12 is shown in phantom. Upper flange 14 is rigidly connected to tube 16. Lower flange 18 is also rigidly connected to tube 16. Lens 20 fits inside tube 16 and rests upon flange 18. Bracket 22 is secured to flange 14 in slots 24 and 26. Threaded rod 28 passes through a hole in bracket 22. Decorative self-adhesive paper with designs 30, 32, 34 and 36 can be applied to tube 16 so as to beautify it.

Tube 16 is translucent so that light from fluorescent light fixture 12 illuminates designs 30, 32, 34 and 36. Light from fluorescent light fixture 12 illuminates the room in which it is located by passing through tube 16 and lens 20.

Figure 2:
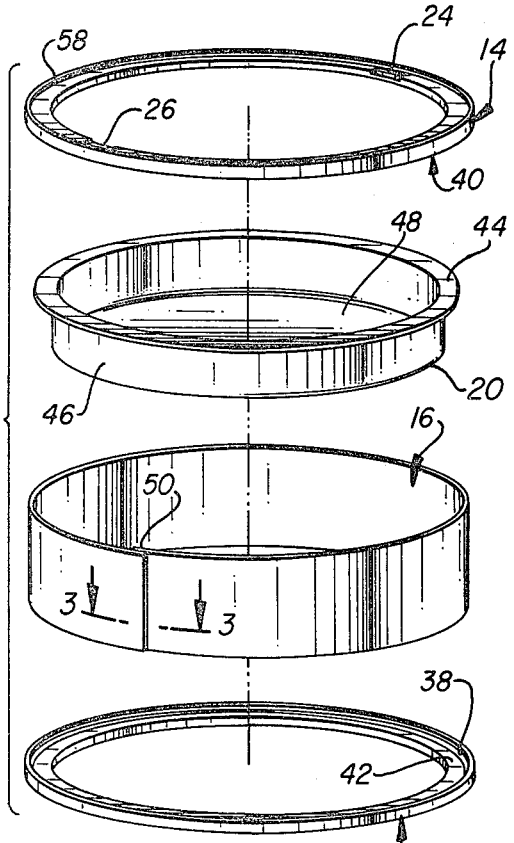
FIG. 2 is an exploded perspective view of the apparatus shown in FIG. 1.

Referring now to FIG. 2, component parts of lampshade 10 are shown in an exploded view. The upper flange 14 and the lower flange 18 are each formed from an integral piece of plastic such as acrylic, polyester or acrylonitrile butadiene styrene (ABS). Such plastic flanges may be formed by milling or molding and provide lightweight yet strong support for the tube 16. Flange 18 has groove 38 formed in its top surface for receiving tube 16. Flange 14 has a similar groove 40 formed on its bottom surface. As shown in the preferred embodiment, flanges 14 and 18 are translucent, thereby passing light into the room where the shade is located. Of course, flanges 14 and 18 can be formed of opaque material without departing from the spirit of the invention.

Tube 16 is cut or formed from a thin, flexible, translucent sheet of plastic such as acrylic, polyester or acrylonitrile butadiene styrene (ABS). After cutting, the flexible piece of plastic is bent into the shape of a tube and fitted inside groove 38 of flange 18 and groove 40 in flange 14. A suitable adhesive is used to join flange 14 to tube 16 in groove 40 and to join tube 16 to flange 18 in groove 38. Tube 16 may be circular in cross-section, as shown in the preferred embodiment. However, other shapes of tube 16, utilizing different cross-sectional figures, such as squares, hexagons, or octagons, will be suggested to those skilled in the art.

In the preferred embodiment, lens 20 is molded from a translucent plastic such as acrylic, polyester or acrylonitrile butadiene styrene (ABS). Lens 20 is formed in the shape of a pan with a lip 44 extending radially outwardly from the peripheral edge of the walls 46 of lens 20. Lens 20 has a bottom surface 48 through which light passes into the room where the lampshade is located. The maximum diameter of lens 20 at lip 44 is greater than that of its diameter between wall 46. The diameter of lens 20 at lip 44 is such that lens 20 fits inside tube 16 and lip 44 rests upon the surface 42 of lower flange 18. In the preferred embodiment, lens 20 is constructed of a single piece of plastic. Lens 20 could also be a translucent disc having a diameter equal to the diameter of lens 20 at lip 44. Other configurations of lens 20 will be suggested to those skilled in the art.

Figure 3:
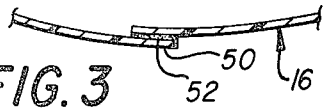
FIG. 3 is a sectional view along line 3—3 in FIG. 2.

Referring to FIG. 3, the sheet of plastic forming tube 16 overlaps and is generally indicated by 50. Adhesive 52 between the pieces of tube 16 provides strength and permanency in the construction of tube 16. Groove 38 in flange 18 and groove 40 in flange 14 must be of sufficient width to accommodate the thickness of the overlapping portion 50 of tube 16.

Figure 4:
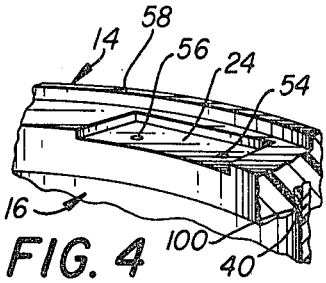
FIG. 4 is a detailed view of the slot seen in FIG. 2.

Referring now to FIG. 4, the groove 40 defined in the bottom surface of upper flange 14 is shown in detail. Slot 24 is formed of sufficient size to accommodate bracket 22. Slot 24 is formed of a depth sufficient to permit two holes 54 and 56 to be formed in flange 14.

Lip 58 formed on the top surface of flange 14 is shown in FIG. 4. Lip 58 is formed on the outer peripheral edge of flange 14 and extends above the top surface of flange 14 a short distance. Lip 58 is of narrow cross section.

Figure 5:
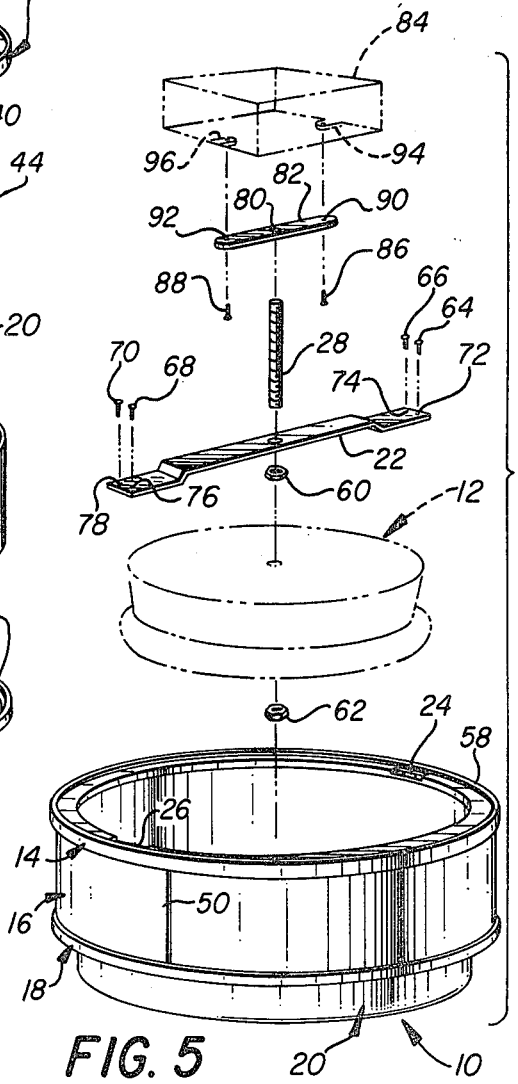
FIG. 5 is an exploded view of the hanging structure shown in FIG. 1.

FIG. 5 shows the preferred technique for the installation of lampshade 10. Fluorescent lamp 12, shown in phantom, fits inside lampshade 10. Threaded rod 28 passes through mounting bracket 22 and fluorescent lamp 12. Retaining nuts 60 and 62 secure fluorescent lamp 12 and mounting bracket 22 to threaded rod 28. Screw 64 passes through hole 72 in mounting bracket 22 and into hole 54 of flange 14. Screw 66 passes through hole 74 in mounting bracket 22 and into hole 56 of flange 14. Similarly, screws 68 and 70 pass through holes 76 and 78 and into holes (not shown) in slot 26. Screws 64, 66, 68 and 70 secure mounting bracket 22 to flange 14. Slots 24 and 26 are placed diametrically opposite each other in flange 14.

Threaded rod 28 threads through hole 80 in hanging bar 82. Ceiling box 84 shown in phantom is attached to the ceiling of the room in which lampshade 10 is to be installed. Screws 86 and 88 pass through holes 90 and 92 in hanging bar 82 and thread into ears 94 and 96 of ceiling box 84. FIG. 5 illustrates a preferred technique for securing lampshade 10 to the ceiling of the room in which it is desired to be installed.

As seen in FIG. 5, bracket 22 supports lampshade 10 and lens 20. Unlike prior devices, lens 20 does not support the weight of lampshade 10. Prior lampshade lenses, unlike lens 20, had nuts threaded onto rods located in the centers of the lenses. Lens 20 thus passes more light into the room than previous lampshades because it has no nut to block the light. Lens 20 also less apt to break or crack from age and stress since it does not support the weight of lampshade 10.

Figure 6:
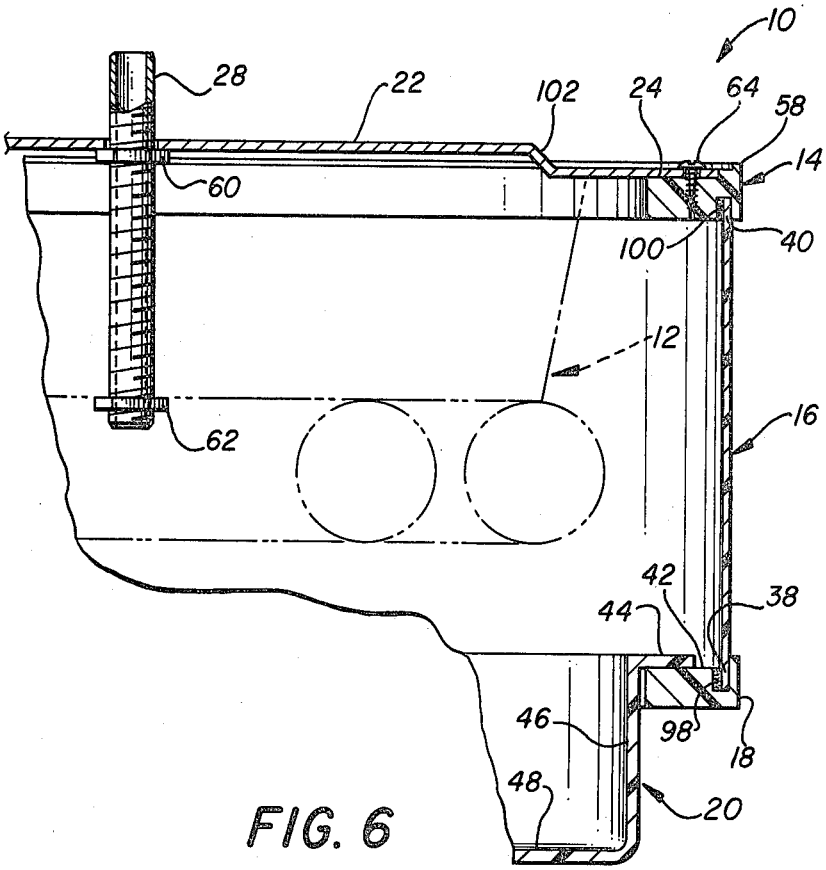
FIG. 6 is a cross-sectional view of one embodiment of the invention.

FIG. 6 illustrates the construction of lampshade 10. Tube 16 fits into groove 38 of flange 18. Adhesive 98 rigidly secures tube 16 in groove 38. Tube 16 fits into groove 40 of flange 14. Adhesive 100 is rigidly secures tube 16 in groove 40. Lip 44 of lens 20 rests upon top surface 42 of flange 18. The diameter of lip 44 of lens 20 is seen to be less than the diameter of tube 16, but greater than the inner diameter of flange 18.

As shown in FIG. 6, the present invention provides for cooling the fluorescent lamp 12. Bracket 22 has a bend 102 located between the end of the bracket 22 and the hole through which threaded rod 28 passes. Bend 102 provides clearance between the ceiling and flange 14. Hot air created by the operation of lamp 12 escapes through the gap created between the ceiling and flange 14.

FIG. 6 illustrates a preferred technique for attaching mounting bracket 22 to lampshade 10. Bracket 22 fits into slot 24 of flange 14. Slot 24 is formed on the top side of flange 14. A screw 64 rigidly secures bracket 22 to flange 14 in slot 24.

Figure 7:
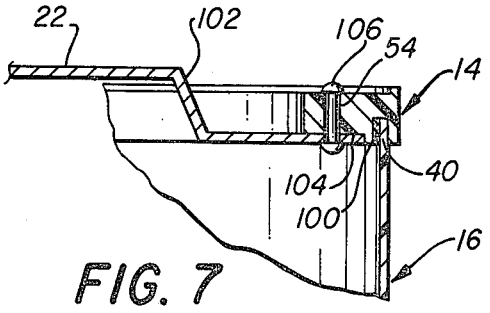
FIG. 7 is a cross-sectional view of another embodiment of the invention.

FIG. 7 shows an alternate method of attaching mounting bracket 22 to lampshade 10. A slot 104 is formed on the lower surface of flange 14. Bracket 22 fits into slot 104. In the preferred embodiment, a rivet 106 passes through hole 54 in flange 14. Bend 102 in bracket 22 must be greater in FIG. 7 than in FIG. 6 to compensate for the thickness of flange 14. The mounting technique illustrated in FIG. 6 is primarily utilized in a factory because of the tools required to secure rivet 106 to flange 14.

From the foregoing, it will be understood that the present invention comprises an apparatus for fitting about a fluorescent light which incorporates numerous advantages over the prior art. The invention is composed of plastic, without using scarce resources. Two means of attaching the invention to a mounting bracket are shown. Of particular significance is the fact that decorative contact paper can be applied to the lampshade to beautify its appearance. The lens does not support the weight of the lampshade as in the prior art.

The present invention is also suitable for the application of contact paper about the shade. This contact paper can be applied so as to make the lampshade coordinate with any decor.

Since the contact paper is not an integral part of the lampshade, it can be changed to suit the decor of the room should the decor in which the shade is found be changed.

Although particular embodiments of the invention have been illustrated in the accompanying Drawings and described in the foregoing Detailed Description, it will be understood that the invention is not limited to the embodiments disclosed, but is intended to embrace any alternatives, modifications, rearrangements, and substitutions of parts of elements as fall within the spirit and scope of the invention.

We claim:

1. A lampshade in combination with a fluorescent lamp for attachment to a mounting bracket suspended from a ceiling comprising:

a circular translucent shade formed from a flexible, thin-walled sheet of plastic, and dimensioned to fit about the fluorescent lamp for diffusing the light from the lamp, a circular upper flange formed from an integral plastic body, said flange having upper and lower surfaces, a circular groove formed on said lower surface and having the same diameter as said shade, a lip formed on said lower surface and located on the outer peripheral edge of said flange, said shade rigidly attached to said upper flange, means for attaching said upper flange to the mounting bracket, a circular lower flange formed from an integral plastic body, said flange having an upper surface, a circular groove formed on said upper surface and having the same diameter as said shade, a lip formed on said upper surface and located on the outer peripheral edge of said flange, said shade rigidly attached to said lower flange in said groove, and a translucent, circular, plastic lens having a diameter less than said shade and dimensioned to rest upon said upper surface of said lower flange for diffusing the light from the lamp.

2. The lampshade of claim 1 wherein said upper flange and said lower flange are constructed of translucent plastic.

3. The lampshade in claim 1 wherein said attaching means comprises:

at least two slots formed on the top of said upper flange, said slots receiving the bracket, and connective means for securing the bracket in said slots.

4. The lampshade in claim 1 wherein said attaching means comprises:

at least two slots formed on the bottom of said upper flange, said slots receiving the bracket; and connective means for securing the bracket in said slots.

* * * * *

UNITED STATES PATENT AND TRADEMARK OFFICE

CERTIFICATE OF CORRECTION

PATENT NO. : 4,344,115

DATED : August 10, 1982

INVENTOR(S) : Jay W. Pickens and Linton G. Warren

It is certified that error appears in the above-identified patent and that said Letters Patent are hereby corrected as shown below:

On the title page

[22] Filing date "August 11, 1981" should be --August 11, 1980--.

Signed and Sealed this

*Twenty-first* Day of *December 1982*

[SEAL]

*Attest:*

GERALD J. MOSSINGHOFF

*Attesting Officer*

*Commissioner of Patents and Trademarks*